United States Patent [19]

DelGrande

[11] 4,252,847

[45] * Feb. 24, 1981

[54] STAINED GLASS STRUCTURE

[76] Inventor: Donald J. DelGrande, 3526 N. Mascher St., Philadelphia, Pa. 19140

[ * ] Notice: The portion of the term of this patent subsequent to Oct. 30, 1996, has been disclaimed.

[21] Appl. No.: 957,029

[22] Filed: Nov. 2, 1978

[51] Int. Cl.[3] ..... B44F 1/06

[52] U.S. Cl. ..... 428/38; 52/311; 156/63; 156/276; 156/329; 428/45; 428/429

[58] Field of Search ..... 52/311; 156/63, 329, 156/276; 428/38, 49, 57, 58, 192, 428, 429; 427/205

[56] References Cited

U.S. PATENT DOCUMENTS

| | | | |
|---|---|---|---|
| 2,095,402 | 10/1937 | Stark, Jr. | 428/38 |
| 2,722,496 | 11/1955 | Hosmer | 228/124 |
| 2,798,577 | 7/1957 | LaForge, Jr. | 156/276 X |
| 2,848,802 | 8/1958 | Luks | 228/121 |
| 2,897,409 | 7/1959 | Gitto | 29/625 X |
| 2,991,213 | 7/1961 | Williams | 428/38 X |
| 3,013,344 | 4/1962 | Sher et al. | 29/625 X |
| 3,060,062 | 10/1962 | Katz et al. | 427/96 |
| 3,132,204 | 5/1964 | Giellerup | 174/117 |
| 3,146,125 | 8/1964 | Schneble, Jr. et al. | 427/98 X |
| 3,247,046 | 4/1966 | Fazekas | 428/38 |
| 3,283,401 | 11/1966 | Pijls | 228/175 |
| 3,391,455 | 7/1968 | Hirohata et al. | 427/125 X |
| 3,420,728 | 1/1969 | Haverstock | 428/38 |
| 3,420,730 | 1/1969 | Ellefson | 428/38 |
| 3,438,840 | 4/1969 | George | 428/45 |
| 3,506,482 | 4/1970 | Hirohata et al. | 428/208 X |
| 3,652,372 | 3/1972 | Klazkin et al. | 156/298 X |
| 3,655,493 | 4/1972 | Campbell | 428/38 |
| 3,676,920 | 7/1972 | Pilditch | 52/747 X |
| 3,791,910 | 2/1974 | Bowser | 428/34 |
| 3,886,677 | 6/1975 | Behring et al. | 428/14 X |
| 3,916,042 | 10/1975 | Grietens | 427/269 |
| 4,033,668 | 7/1977 | Presby | 350/96 C |
| 4,154,880 | 5/1979 | Drennan | 428/38 |

FOREIGN PATENT DOCUMENTS

| | | | |
|---|---|---|---|
| 1962912 | 6/1971 | Fed. Rep. of Germany | 428/432 |

*Primary Examiner*—Henry F. Epstein

*Attorney, Agent, or Firm*—Steele, Gould & Fried

[57] ABSTRACT

A method for bonding the edges of pieces of stained glass, comprising the steps of applying adhesive to the edges, coating the adhesive with solderable metallic particles while the adhesive is still tacky, and, after the adhesive is cured, soldering the edges together, thereby joining the pieces of glass into a self-supporting structure. The method may also be utilized to solder a stained glass window directly into a frame. The adhesive is preferably a high-temperature resistant adhesive, and the solderable metallic particles are preferably a combination of copper granules and powder.

12 Claims, 7 Drawing Figures

STAINED GLASS STRUCTURE

BACKGROUND OF THE INVENTION

1. Field of Invention

This invention relates to the field of bonding glass, and in particular, to a new method for building stained glass structures.

2. Prior Art

The classical method for building decorative, stained glass structures has involved the use of lead came, an H-shaped lead molding. This molding is inserted between every joint in a stained glass structure, being soldered together wherever possible in order to create a continuous lead perimeter for each piece of stained glass in the structure. Putty or other suitable caulking would then have to be pressed into the came, between it and each piece of glass in order to weatherproof the structure. Such structures require substantial reinforcement, in addition to that provided by the soldered lead perimeters, and accordingly, such a method is expensive and time consuming. Further, even when reinforced, such structures are subject to sagging, requiring frequent resoldering or recaulking. It is also very difficult to make repairs, that is, to replace a single piece of glass without dismantling large portions of the structure.

A recent improvement in the construction of stained glass structures involves edging each piece of glass with a thin strip of metal, usually copper. Each piece of glass is surrounded with a thin metal strip which is soldered into a continuous perimeter member. After each piece of glass is so treated, the pieces of glass may then be soldered to one another by application of the solder to the metal strips. While this method is simpler than that involving the lead came, it still requires caulking for weatherproofing, and still requires that each piece of glass be sealed within a continuous metal perimeter. Even if one wants it only to join two pieces of glass along one mutual edge, it would still be necessary to provide each piece of glass with a continuous metal strip perimeter.

Both of the foregoing methods share several significant disadvantages. One disadvantage is that both methods are relatively expensive and quite time-consuming. A second disadvantage is that structures produced by each method require caulking or other sealing means to be applied in order to weatherproof the structures. This is particularly significant for the use of stained glass windows.

A third disadvantage is the lack of rigidity or self-support of the structures themselves. The maximum size of an unreinforced stained glass window produced by either of these methods is approximately 30″×30″. Anything beyond this size requires reinforcing members.

This invention overcomes all of these disadvantages, by teaching a method for bonding the edges of pieces of stained glass, comprising the steps of applying adhesive to the edges, coating the adhesive with solderable metallic particles while the adhesive is still tacky, and, after the adhesive has cured, soldering the edges together, thereby joining the pieces of glass into a substantially self-supporting structure. The adhesive is a high-temperature resistant adhesive, preferably of silicone base. The solderable metallic particles are a combination of granules and powder, preferably copper. The method is quick, inexpensive and provides much larger self-supporting stained glass structures than is possible with the known methods described above.

With respect to cost, a comparison of the methods involving lead came, copper foil and this invention, revealed that for a given stained glass joint, this invention is more than one thousand times less expensive than the lead came method and approximately three times less expensive than the copper foil method.

With respect to labor, for preparing a given length glass joint, this invention is approximately seven times faster than the lead came method and four times faster than the copper foil method, not including the curing time of the adhesive. This is a reasonable assumption, inasmuch as by the time the last piece of glass in a structure has been treated, the adhesive on the first treated pieces of glsss has cured and they are available for soldering.

With respect to rigidity and self-supportability, a stained glass window made by the copper foil or lead came method must be provided with additional structural support if the dimensions exceed approximately 30″×30″. With this invention, no additional structural support is necessary until a size of approximately 40″×40″ is exceeded. This is an increase in unsupported area of approximately 77%. Further, even for larger structures, stained glass structures made according to this invention require less support.

With respect to ease of repairs, a stained glass structure built according to this invention can be desoldered and resoldered. This makes the replacement of a broken piece of glass a relatively simpler matter.

Finally, a stained glass structure built according to this invention is inherently weatherproof, without the need for any additional putty or caulking. The method taught in this invention is so effective, that a stained glass window may be soldered directly into a wood window frame. As with the seams between the pieces of stained glass, this seam also requires no additional caulking to be weatherproof.

SUMMARY OF THE INVENTION

It is an object of this invention to provide an improved method for building glass structures, including stained glass structures.

It is another object of this invention to provide an improved method for treating the edges of pieces of glass, so that they may be soldered directly together.

It is still another object of this invention to provide an improved method for building stained glass structures which are inherently weatherproof.

It is still another object of this invention to provide a means for soldering stained glass windows directly to wood frames.

It is yet another object of this invention to provide a substantially-self-supporting stained glass structure.

It is a still further object of this invention to provide a method for joining pieces of glass at right angles to one another without the need of encircling either piece of glass with a continuous metal perimeter.

These and other objects are accomplished by a method for bonding the edges of pieces of stained glass, comprising the steps of applying adhesive to the edges, coating the adhesive with solderable metallic particles while the adhesive is still tacky, and, after the adhesive is cured, soldering the edges together, thereby joining the pieces of glass into a self-supported structure. The adhesive is a high-temperature resistant adhesive, preferably of silicone base. The solderable metallic particles are preferably a combination of granules and powder, preferably of copper. The method is also effective for joining glass to wood, a layer of adhesive being applied to the edges of the glass and a layer of adhesive being applied to, for instance, a wood frame. The bead of solder which joins each edge of glass and/or wood provides a completely weatherproof seal, requiring no additional putty or caulking.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
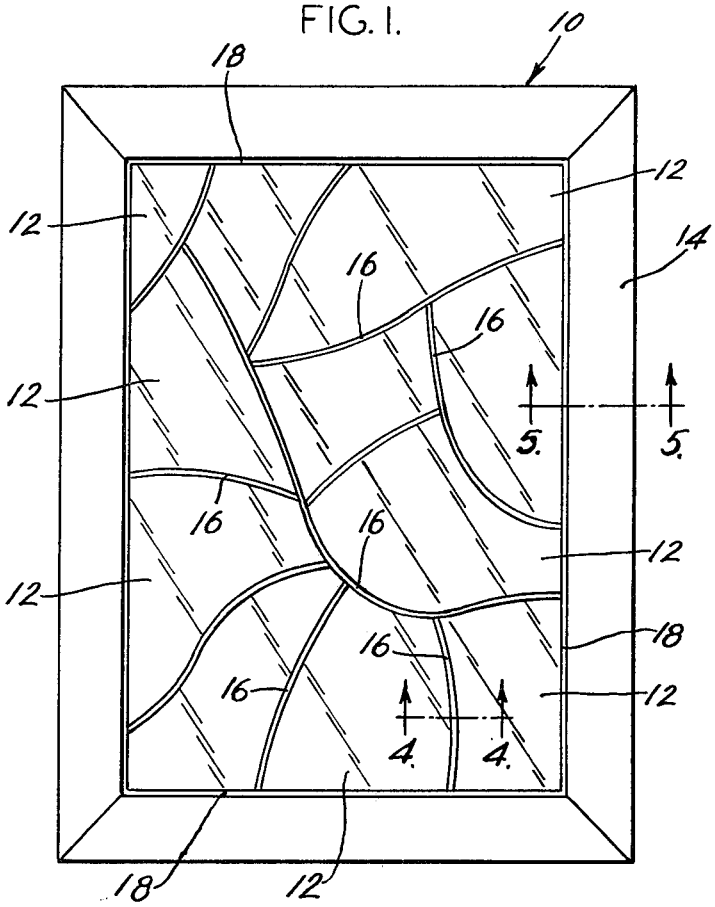
FIG. 1 is a stained glass window constructed in accordance with the methods of this invention.

A representative stained glass structure 10 constructed in accordance with the methods of this invention is shown in FIG. 1. A plurality of pieces of stained glass 12, are joined to one another by a plurality of joints 16, and are joined to frame 14 by a plurality of joints 18. The frame 14 is shown as wood, but may be other materials, such as metal.

Figure 2:
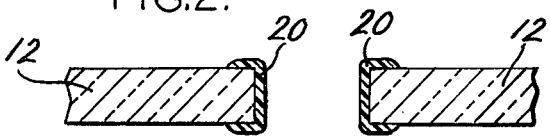
FIGS. 2, 3 and 4 sequentially illustrate the method for joining pieces of glass according to this invention, FIG. 4 also being a section view taken along the line 4—4 in FIG. 1.
Figure 3:
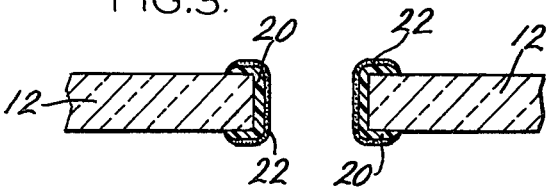
Figure 4:
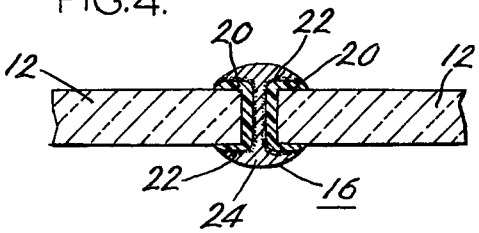

The method for constructing joints 16 is shown sequentially in FIGS. 2, 3 and 4. The first step, illustrated in FIG. 2, is the application of an adhesive layer 20 to each edge of glass which is to be joined. The glue or adhesive 20 should be a high-temperature resistant adhesive, because it must withstand the normal operating temperatures of a typical soldering iron or soldering gun. Two suitable adhesives include silicon base adhesive, such as Dow Corning 734 RTV Silastic and firebrick cement, generally comprising firebrick clay and asbestos fiber, such as Pecora Firebrick Cement. The adhesive or glue 20 preferably covers or substantially covers all of the mutual edges to be joined, as well as a narrow strip on each surface adjoining each edge to be joined. This overlap, illustrated in FIG. 2, is the basis for the neat appearance of the solder bead shown in FIG. 1 as joints 16 and 18. The adhesive 20 may be applied with a foam covered roller or with a brush, the bristles of which have been cut and notched according to the thickness of the glass to be joined. If a mosaic style structure is desired, adhesive is applied to edges only, and not to strips on adjoining surfaces.

The second step, illustrated in FIG. 3, must be performed while the adhesive or glue 20 is still tacky, that is, before it has cured. In the second step, a coating of metallic solderable particles 22 is applied to the adhesive layers 20. Suitable solderable metallic particles include such metals as copper, silver and gold. In size, the particles are preferably a combination of granules and powder, although either alone is still effective. A suitable solderable metallic particle is Alcan metal powder MD No. 41, which is copper. The metallic particles 22 may be applied by sprinkling them over the adhesive layers, or the adhesive layers may be dipped or pressed into trays containing the metallic particles. In either event, a substantially uniform coating is desirable, although not absolutely necessary.

The third and final step, illustrated in FIG. 4, takes place after the adhesive has cured, thereby bonding the metallic particles to the pieces of glass. The edges to be joined are placed in abutting relationship, and soldered together using standard solder, such as a lead-tin composition, and standard soldering irons or soldering guns. The result is a neat solder bead 24 which completely seals the joint 16. This joint is weatherproof and waterproof.

Figure 5:
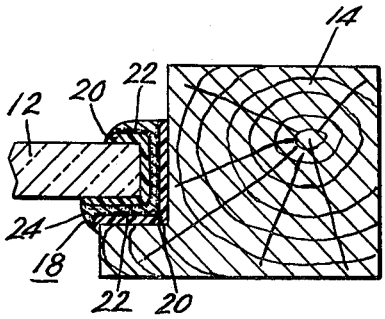
FIG. 5 is a section view taken along the line 5—5 in FIG. 1.

The method described herein is also suitable for joining stained glass 12 to wood frame 14. As shown in FIG. 5, an adhesive layer 20 is applied to the edge of glass 12 and the mounting lip or notch of frame 14. While these adhesive layers 20 are still tacky, a coating of solderable metallic particles 22 is applied to each, in the manner described hereinbefore. After the adhesive has cured, the glass and wood frame may be soldered directly together, forming joint 18. Joint 18 is as waterproof and weatherproof as joint 16. This method would also be effective with a metal frame.

Figure 6:
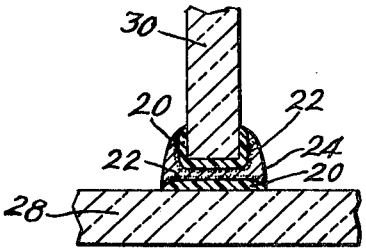
FIG. 6 illustrates a right-angle bond between two pieces of glass in accordance with this invention; and, FIG. 7 is a plan view of a multiple pane window structure in accordance with this invention.

The method described herein is also effective for joining any kind of glass in any desired orientation, as well as in edge to edge relationship. Illustrated in FIG. 6 are pieces of glass 28 and 30, disposed at right angles to one another. If such a joint were to be made by the lead came or copper foil methods, it would be necessary to encircle each piece of glass with a continuous metal perimeter. The perimeters would then be soldered together, and it would still be necessary to caulk the joint. It would probably also be necessary to buttress the joint, if one of the pieces of glass projected outward, instead of possibly being balanced in an upright position as shown in FIG. 6. However, when the joint is accomplished by the methods of this invention, it is necessary only to apply adhesive to those surfaces or edges which will actually be joined. Continuous metal perimeters are completely unnecessary. As illustrated, one first applies layers of adhesive 20 and coatings of metallic particles 22. After the adhesive is cured, the pieces of glass are soldered together by solder bead 24. This joint is strong enough to support an outthrusting piece of glass, of reasonable weight, without additional support.

Figure 7:
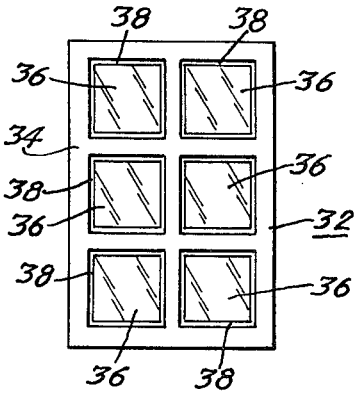

The method of this invention, and the products produced thereby, particularly lend themselves to being repaired. In particular, it is very easy to replace any particular piece of glass, which may have become broken, by desoldering the joint and replacing the glass with a new piece, the edges of which have been treated in accordance with the method of this invention, that is, applying an adhesive to the edges, and, while the adhesive is tacky, coating the adhesive with solderable metallic particles. Such a piece may be easily soldered into place. The repaired joint will be as strong, weatherproof and waterproof as the original joint. In this regard, the method of this invention is also suitable for building ordinary framed window structures and multiple pane window structures, irrespective of whether or not the glass is ordinary or stained glass or plastic panes such as Plexiglas. Such use is illustrated in FIG. 7, which shows a multiple window pane structure 32, having frame 34 and panes of glass 36, secured by joints 38 similar to joint 18 shown in FIG. 5.

The present invention may be embodied in other specific forms without departing from the spirit or essential attributes thereof, and accordingly, reference should be made to the appended claims, rather than to the foregoing specification as indicating the scope of the invention.

I claim:

1. A self-supporting glass structure having at least two pieces of glass, wherein each joint between said pieces of glass comprises:

a layer of adhesive bonded to each joined surface of said pieces of glass;

a coating of solderable metallic particles bonded to each said adhesive layer; and, a bead of solder bonded to each said coating of solderable metallic particles, thereby joining said pieces of glass.

2. The glass structure of claim 1, wherein all border edges of said pieces of glass comprise:

a layer of adhesive bonded to each border edge;

a coating of solderable metallic particles bonded to each said adhesive layer; and, a bead of solder bonded to each said coating of solderable metallic particles.

3. The glass structure of claim 1, wherein said particles are a combination of granules and powder.

4. The glass structure of claim 1, wherein said adhesive is a high temperature resistant adhesive.

5. The glass structure of claim 1, wherein the adhesive substantially covers each soldered edge, as well as a narrow strip on each surface bordering each said soldered edge.

6. The glass structure of claim 1, wherein said particles are copper.

7. The glass structure of claim 1, further comprising a frame for said glass structure, said frame and said structure being connected by a joint comprising:

a layer of adhesive bonded to each perimeter edge of glass and said frame structure;

a coating of solderable metallic particles bonded to each said adhesive layer; and, a bead of solder bonded to each said coating of solderable metallic particles.

8. The glass structure of claim 7, wherein said frame is wood.

9. The glass structure of claim 7, wherein said frame is metal.

10. The glass structure of claim 1, wherein said pieces of glass are stained glass.

11. A window assembly, comprising:

at least one window pane;

a frame structure surrounding the at least one window pane; and, the at least one window pane and the frame being joined to one another by joints comprising:

a layer of adhesive bonded to each edge of the at least one window pane and to corresponding portions of the frame;

a coating of solderable metallic particles bonded to each of the adhesive layers; and, a bead of solder bonded to each of the coatings of metallic particles.

12. The window assembly of claim 11, comprising a plurality of window panes, each surrounded by, and joined to portions of the frame structure.

* * * * *